US010728967B1

(12) United States Patent
Treadway et al.

(10) Patent No.: US 10,728,967 B1
(45) Date of Patent: Jul. 28, 2020

(54) SURFACE MOUNTED LED LIGHT STRUCTURE

(71) Applicant: MAXLITE, INC., West Caldwell, NJ (US)

(72) Inventors: Patrick Treadway, Rancho Cucamonga, CA (US); James Steedly, Menifee, CA (US)

(73) Assignee: MAXLITE, INC., West Caldwell, NJ (US)

( * ) Notice: Subject to any disclaimer, the term of this patent is extended or adjusted under 35 U.S.C. 154(b) by 616 days.

(21) Appl. No.: 14/548,051

(22) Filed: Nov. 19, 2014

Related U.S. Application Data

(60) Provisional application No. 61/906,099, filed on Nov. 19, 2013.

(51) Int. Cl.
*H05B 33/08* (2020.01)
*H05B 45/00* (2020.01)

(52) U.S. Cl.
CPC ..... *H05B 45/00* (2020.01)

(58) Field of Classification Search
CPC ..... H05B 33/0803
See application file for complete search history.

(56) References Cited

U.S. PATENT DOCUMENTS

2008/0030981 A1* 2/2008 Mrakovich ..... G02B 6/001 362/219
2009/0147504 A1* 6/2009 Teeters ..... F21V 23/06 362/153
2010/0134047 A1* 6/2010 Hasnain ..... F21V 23/0442 315/302
2012/0039082 A1* 2/2012 Rodriguez Barros ..... B60Q 1/2665 362/494
2012/0319582 A1* 12/2012 Shan ..... H05B 33/0803 315/77
2013/0027929 A1* 1/2013 McMillan ..... F21V 17/002 362/235
2013/0249375 A1* 9/2013 Panagotacos ..... H05B 33/0803 313/13
2014/0104843 A1* 4/2014 McCane ..... F21V 3/0445 362/282

* cited by examiner

*Primary Examiner* — Amr A Awad
*Assistant Examiner* — Jonathan G Cooper
(74) *Attorney, Agent, or Firm* — Budzyn IP Law, LLC

(57) ABSTRACT

A surface mounted LED light structure has a V-shaped channel with opposed legs and a flat central portion. A flat base strip is attached to each leg. The strips each have a pair of electrically conductive traces. A plurality of LEDs is arrayed along the base strips and electrically connected to the traces. A diffuser is disposed over the LEDs. A spacer sleeve holds the diffuser over the channel central portion. A driver is mounted adjacent the channel and is connected to the conductive traces and to the power source.

3 Claims, 6 Drawing Sheets

SURFACE MOUNTED LED LIGHT STRUCTURE

CROSS-REFERENCE TO RELATED APPLICATION

This application claims priority to U.S. Provisional Patent Application No. 61/906,099, filed Nov. 19, 2013, the entire contents of which are incorporated by reference herein.

FIELD OF THE INVENTION

This invention relates to LED luminaires and, more particularly, to a lamp having a plurality of LEDs mounted on an elongated structural member.

BACKGROUND OF THE INVENTION

LED (light emitting diode) luminaires are coming into common use in commercial, institutional, and residential buildings. Some are designed with the look of a traditional fluorescent fixture, having a recessed Troffer housing. Some are screw thread based, to replace incandescent bulbs. Some are flat panels, typically mounted in ceilings. All operate with the energy saving and long life benefits of LED technology. LED luminaires are offered in correlated color temperatures (CCT), for example, of 3500K (warm light), 4100K (cool white), and 5000K (daylight). An infinite number of CCTs are available beyond these examples.

It is often desired to illuminate an area with a diffuse light source that can be suspended from a ceiling, or mounted in a Troffer housing. An elongated light source is especially useful under a long cabinet or for projecting light against a wall. Utilizing a panel having multiple LEDs would render the light source lightweight, powerful, and economical to operate. Using a diffuser shade would provide a soft and omni-directional light, for comfortable reading or residential area light. In addition, the LED light source is environmentally benign, having a low carbon footprint.

The current industry standard is to mount LEDs on a rigid PCB. This limits the geometry of the product to two dimensions, or some variation of two dimensional figures connected together. The PCB board is brittle and has other structural and aesthetic limitations. The PCB board, and its associated copper traces, cannot stand flexing and bending without damage. Hence, an elongated light source would require a mounting structure strong and rigid enough to support a strip of LEDs on a PCB and support a diffuser and associated wiring.

There is a need, therefore, for a surface mounted LED light structure that will be powerful, and that can provide soft and omni-directional light for comfortable reading.

There is a further need for a surface mounted LED light structure as described, and that has a mounting structure strong and rigid enough to support a strip of LEDs on a PCB.

There is a yet further need for a surface mounted LED light structure as described, and that has a low profile for retrofit mounting in a Troffer housing.

There is a still further need for a surface mounted LED light structure as described, and that can be manufactured in large quantities of high quality, and in a cost-effective manner.

SUMMARY

In a first aspect, a surface mounted LED light structure is for use in connection with an electrical power source and a driver operatively electrically connected to the power source. The light structure comprises a channel extending between opposite first and second ends. The channel has a generally flat central portion, with opposite generally flat left and right legs extending outward on either side from the central portion. A base strip is attached to one of either the channel left or right legs. A plurality of LEDs is arrayed along the base strip, and operatively connected to the driver.

In a second aspect, a surface mounted LED light structure is for use in connection with an electrical power source and a driver operatively electrically connected to the power source. The light structure comprises a channel having a trough-shaped cross section extending between opposite first and second ends. The cross section has a generally flat central portion, with opposite generally flat left and right legs extending outward on either side from the central portion. A generally flat and elongated base strip, which is electrically nonconductive, is attached to one of the channel left and right legs. A plurality of LEDs is arrayed in a linearly spaced relation along the base strip. The LEDs are operatively electrically connected to the driver. A diffuser is juxtaposed with the channel and disposed over the LEDs for diffusing light emitted by the LEDs. Mounting means is provided for mounting the diffuser on the channel.

In a third aspect, a surface mounted LED light structure is for use in connection with an electrical power source and a driver operatively electrically connected to the power source. The light structure comprises a channel having a generally V-shaped cross section extending between opposite first and second ends along a central plane. The cross section has bilateral symmetry about the central plane. The cross section has a generally flat central portion generally perpendicular to the central plane. The cross section has opposite generally flat left and right legs extending outward on either side from the central portion. The left and right legs each have an outer surface facing away from the opposite leg and an inner surface facing toward the opposite leg.

A generally flat and elongated first base strip is electrically nonconductive. The first base strip has a pair of electrically conductive traces operatively electrically connected to the driver, and is attached to the channel left leg. A second base strip is also generally flat and elongated, and electrically nonconductive. The second base strip has a pair of electrically conductive traces operatively electrically connected to the driver, and is attached to the channel right leg.

A plurality of LEDs is arrayed in a linearly spaced relation along the first and second base strips. The LEDs are operatively electrically connected to the conductive traces. Means are provided for attaching the base strip to the channel.

A diffuser is juxtaposed with the channel and disposed over the LEDs for diffusing light emitted by the LEDs. A spacer sleeve has a central hole therethrough and is disposed between the diffuser and the channel central portion. A threaded fastener extends through the diffuser, through the spacer sleeve central hole, and through the channel central portion.

A driver is mounted adjacent the channel and operatively electrically connected to the conductive traces. The driver is also operatively connected to the power source.

DETAILED DESCRIPTION OF THE INVENTION

Figure 1:
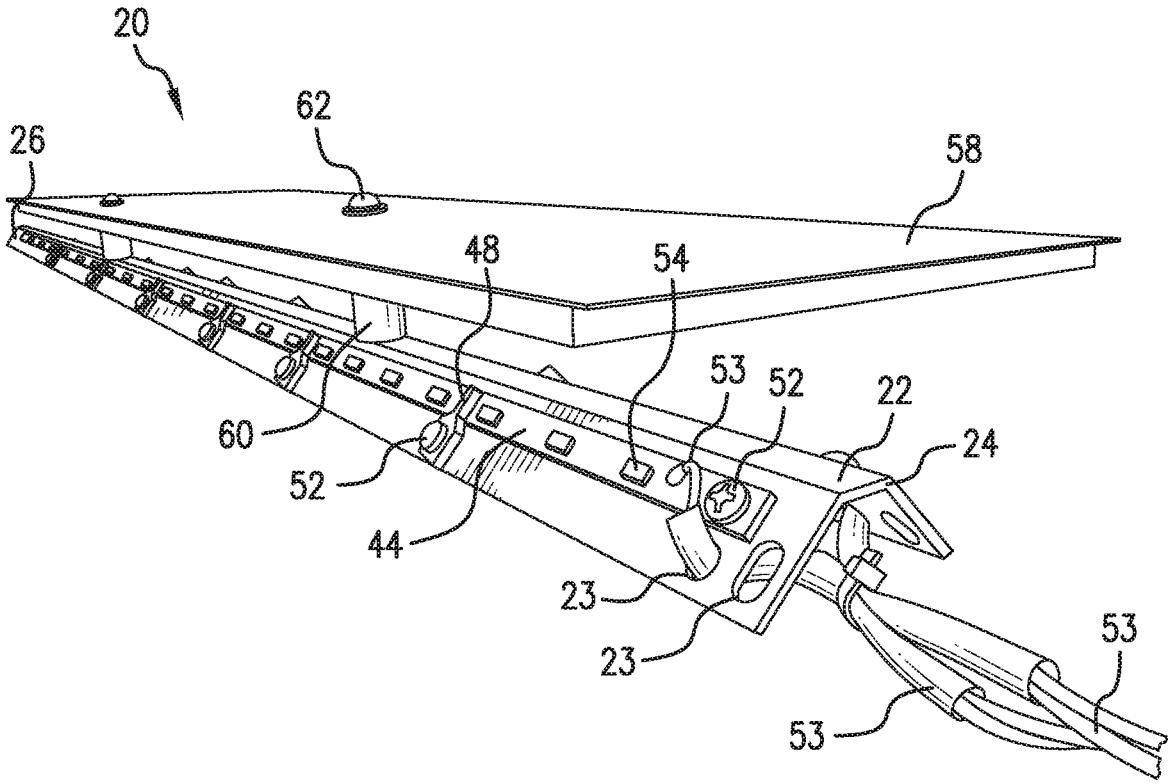
FIG. 1 is a perspective view of a surface mounted LED light structure constructed in accordance with the invention.
Figure 2:
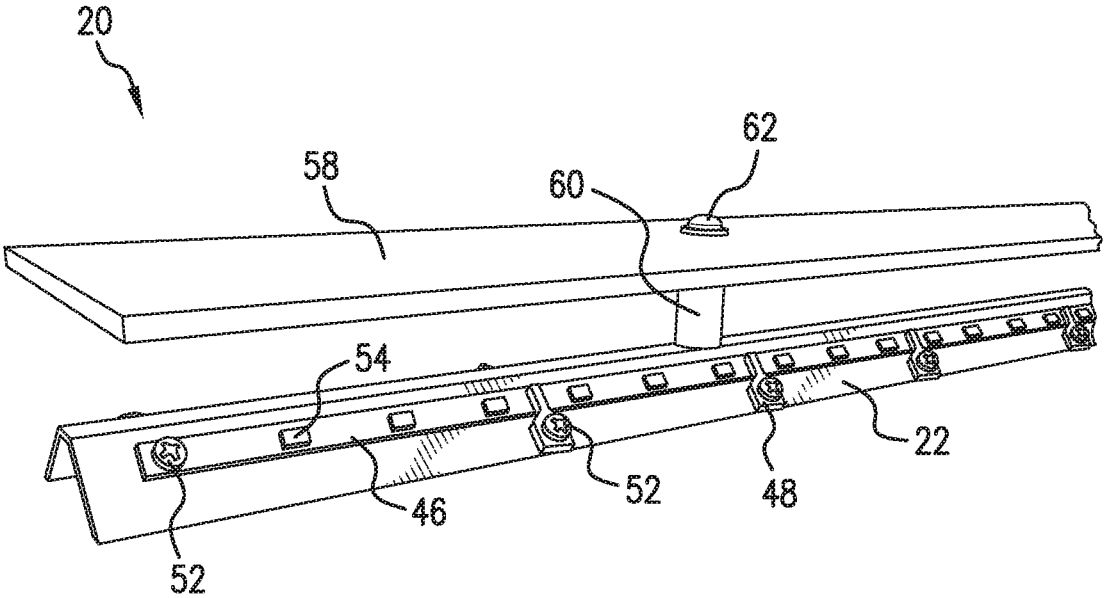
FIG. 2 is a perspective view of the surface mounted LED light structure of FIG. 1.
Figure 3:
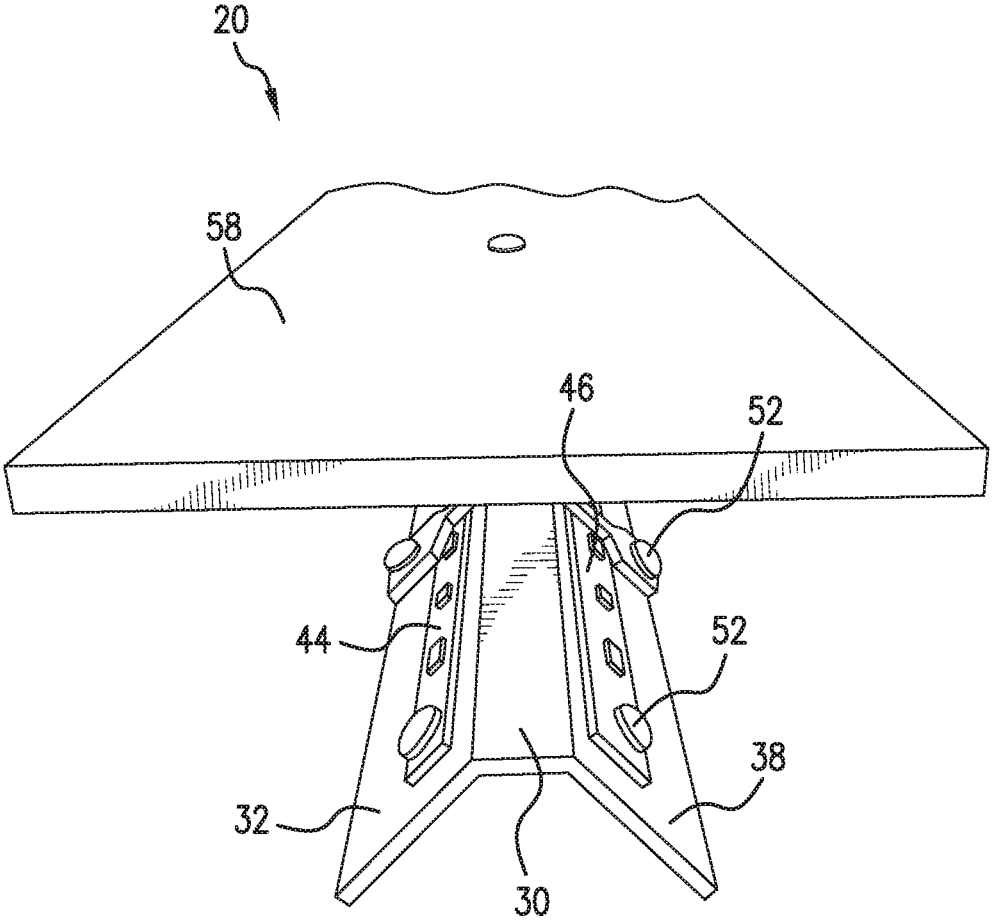
FIG. 3 is a perspective end view of the surface mounted LED light structure of FIG. 1.
Figure 4:
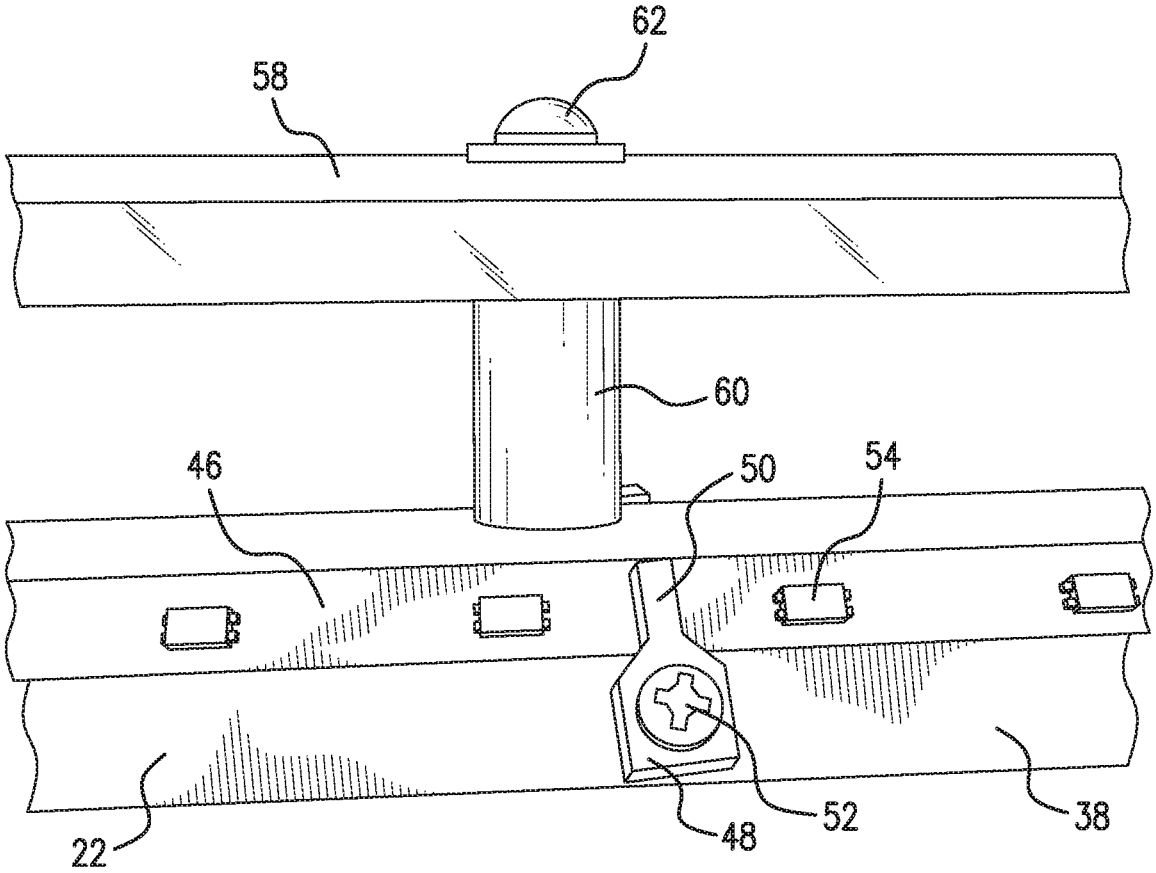
FIG. 4 is a side elevational detail view of the surface mounted LED light structure of FIG. 1.

Referring now to the drawing FIGS. 1-5, a surface mounted LED light structure 20 is for use in connection with an electrical power source and a driver operatively electrically connected to the power source (not shown). The light structure 20 comprises a channel 22 having a generally V-shaped cross section extending between opposite first 24 and second 26 ends along a central plane 28. The cross section has bilateral symmetry about the central plane 28. The cross section has a generally flat central portion 30 generally perpendicular to the central plane 28. The cross section has opposite generally flat left 32 and right 38 legs extending outward on either side from the central portion 30. The left 32 and right 38 legs have a left outer surface 34 and a right outer surface 40 respectively, each facing away from the opposite leg. The left 32 and right 38 legs have a left inner surface 36 and a right inner surface 42 respectively, each facing toward the opposite leg. The channel 22 has holes or slots 23 through which wiring 53 can pass. The slots 23 can also serve to suspend the LED light structure 20 temporarily from a Troffer housing with an S-hook during retrofit.

A generally flat and elongated first base strip 44 is electrically nonconductive. The first base strip 44 has a pair of electrically conductive traces 56, which can be disposed on the first base strip bottom surface 43 or the first base strip top surface 45, or molded within the base strip. The first base strip 44 is attached to the channel left leg 32. A second base strip 46 is also generally flat and elongated, and electrically nonconductive. The second base strip 46 has a pair of electrically conductive traces 56, which can be disposed on the second base strip bottom surface 47 or the second base strip top surface 49, or molded within the base strip. The second base strip 46 is attached to the channel right leg 38. Means for attaching the base strip to the channel typically will be a clip 48 having a finger 50 disposed against the base strip 44, 46 and a fastener 52 holding the clip 48 against the channel 22. It is to be understood that any mounting and attaching means well known to those with ordinary skill in the art may be employed for attaching the base strip to the channel. A variety of other means includes a threaded nut and a threaded bolt, a machine screw inserted into a tapped hole in the channel, a self-tapping sheet metal screw, or a rivet. An adhesive can also be employed. Any alternate mounting and attaching means is to be considered an equivalent embodiment to the preferred embodiments shown, within the spirit and scope of the claims.

Figure 5:
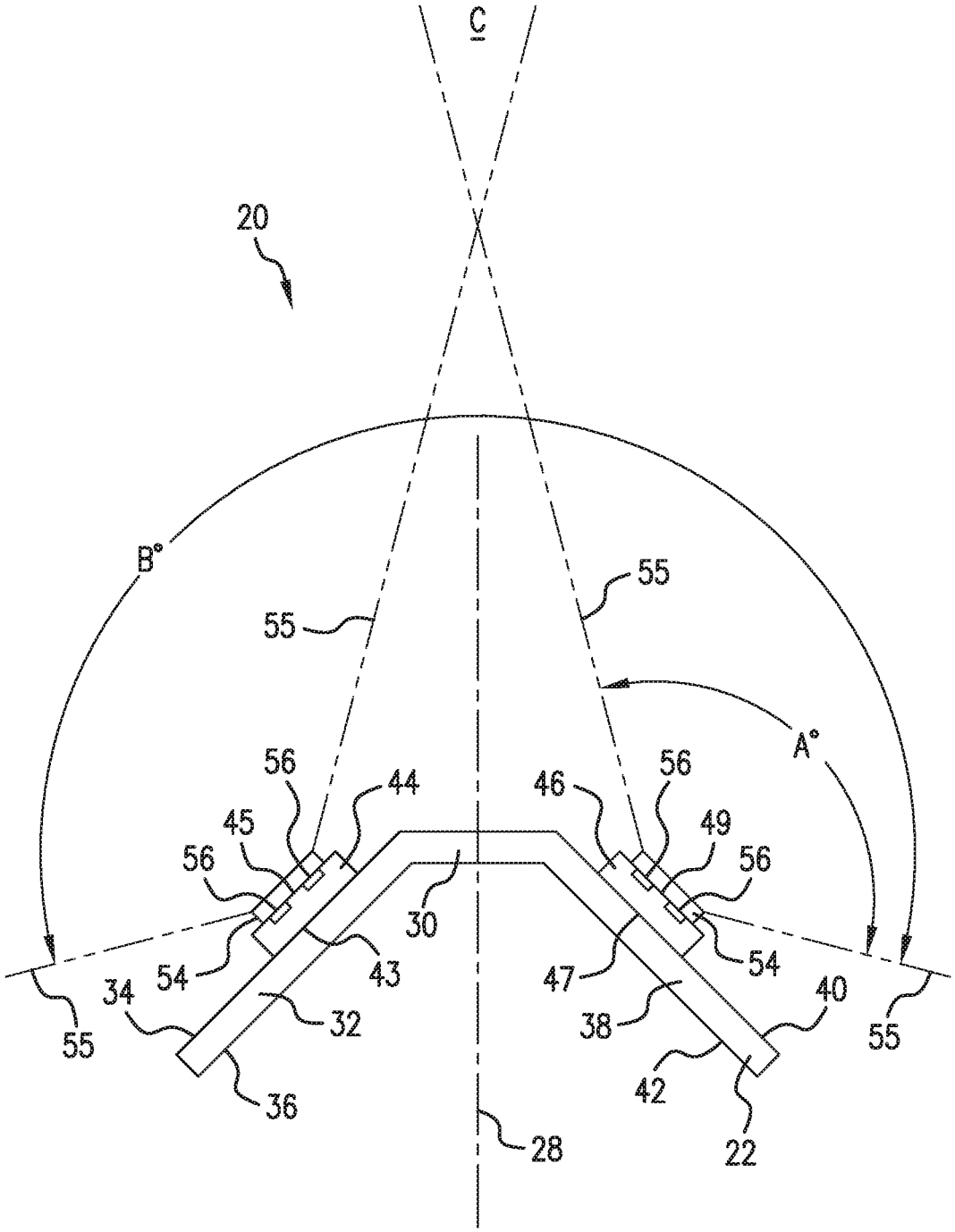
FIG. 5 is a front elevational view of the surface mounted LED light structure of FIG. 1.

A plurality of LEDs 54 is arrayed in a linearly spaced relation along the first 44 and second 46 base strips. The LEDs 54 are operatively electrically connected to the conductive traces. The mounting of the LEDs 54 has two options. The preferred embodiment discloses the first base strip 44 and respective LEDs 54 attached to the channel left leg outer surface 34. The second base strip 46 and respective LEDs 54 are attached to the channel right leg outer surface 40. This is shown in FIG. 5. The angle of emission of light 55 from the LEDs is angle "A", which typically can be between 110° and 120°. The V-shaped channel 22 has legs 32, 38 that preferably extend at a 45° angle from the central plane 28, which is a 90° included angle. It is to be understood that any included angle is to be considered an equivalent embodiment to the preferred embodiments shown, within the spirit and scope of the claims. This arrangement projects light outward from the two strips of LEDs 54 with a slight overlap in region "C". The combination of the two strips of LEDs 54 projects light outward at an angular spread depicted at angle "B" of about 210°. This, too, can vary with the channel angle and the particular LEDs used.

A driver (not shown) is mounted adjacent the channel and operatively electrically connected to the conductive traces by wiring 53. The driver is also operatively electrically connected to the power source.

A diffuser 58 is juxtaposed with the channel 22 and disposed over the LEDs 54 for diffusing light emitted by the LEDs 54. A spacer sleeve 60 has a central hole therethrough and is disposed between the diffuser 58 and the channel central portion 30. A threaded fastener 62 extends through the diffuser 58, through the spacer sleeve central hole, and through the channel central portion 30.

Figure 6:
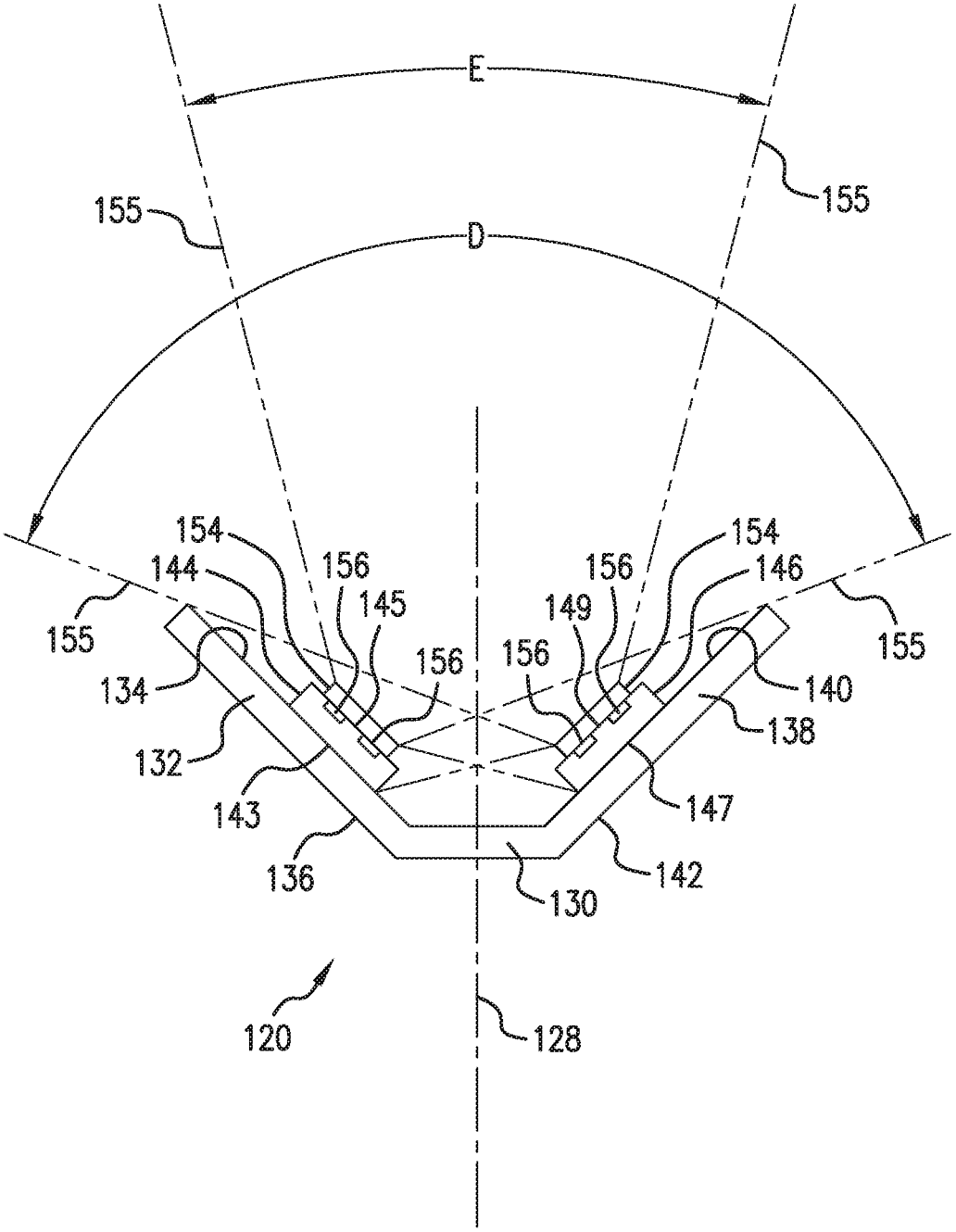
FIG. 6 is a front elevational view of another surface mounted LED light structure constructed in accordance with the invention.

Turning now to FIG. 6, another surface mounted LED light structure 120 is for use in connection with an electrical power source and a driver operatively electrically connected to the power source (not shown). Light structure 120 is similar to surface mounted led light structure 20 in that the light structure 120 comprises a channel 122 having a generally V-shaped cross section extending along a central plane 128. The cross section has bilateral symmetry about the central plane 128. The cross section has a generally flat central portion 130 generally perpendicular to the central plane 128. The cross section has opposite generally flat left 132 and right 138 legs extending outward on either side from the central portion 130. The left 132 and right 138 legs have a left outer surface 134 and a right outer surface 140 respectively, each facing away from the opposite leg. The left 132 and right 138 legs have a left inner surface 136 and a right inner surface 142 respectively, each facing toward the opposite leg.

A generally flat and elongated first base strip 144 is electrically nonconductive. The first base strip 144 has a pair of electrically conductive traces 156, which can be disposed on the first base strip bottom surface 143 or the first base strip top surface 145, or molded within the base strip. The first base strip 144 is attached to the channel left leg 132. A second base strip 146 is also generally flat and elongated, and electrically nonconductive. The second base strip 46 has a pair of electrically conductive traces 156, which can be disposed on the second base strip bottom surface 147 or the second base strip top surface 149, or molded within the base strip. The second base strip 146 is attached to the channel right leg 138.

A plurality of LEDs 154 is arrayed in a linearly spaced relation along the first 144 and second 146 base strips. The LEDs 154 are operatively electrically connected to the conductive traces. The mounting of the LEDs 154 has two options. This embodiment discloses the first base strip 144 and respective LEDs 154 attached to the channel left leg inner surface 136. The second base strip 146 and respective LEDs 154 are attached to the channel right leg inner surface 142. This is shown in FIG. 6. The angle of emission of light 155 from the LEDs is angle "A" (as before from FIG. 5), which typically can be between 110° and 120°. The V-shaped channel 122 has legs 132, 138 that preferably extend at a 45° angle from the central plane 128, which is a 90° included angle. This arrangement projects light outward from the two strips of LEDs 154 with a significant overlap in region "E". The combination of the two strips of LEDs 154 projects light outward at an angular spread depicted at angle "D" of about 138°. This, too, can vary with the channel angle and the particular LEDs used. This embodiment renders a more narrow, intense field of projected light than the above-described surface mounted led light structure 20.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A surface mounted LED light structure, for use in connection with an electrical power source and a driver operatively electrically connected to the power source, the light structure comprising:

a channel having a trough-shaped cross section extending between opposite first and second ends along a central plane, the cross section having bilateral symmetry about the central plane, the cross section having a generally flat central portion generally perpendicular to the central plane, the cross section having opposite generally flat left and right legs extending outward on either side from the central portion, the left and right legs each having an outer surface facing away from the opposite leg and an inner surface facing toward the opposite leg;

a first base strip, the first base strip being generally flat and elongated, the first base strip being electrically nonconductive, the first base strip having a pair of electrically conductive traces operatively electrically connected to the driver, the first base strip being attached to the channel left leg;

a second base strip, the second base strip being generally flat and elongated, the second base strip being electrically nonconductive, the second base strip having a pair of electrically conductive traces operatively electrically connected to the driver, the second base strip being attached to the channel right leg;

a plurality of LEDs arrayed in a linearly spaced relation along the first and second base strips, the LEDs being operatively electrically connected to the conductive traces;

attaching means for attaching the first and second base strips to the channel;

a diffuser juxtaposed with, and spaced from, the channel and disposed over the LEDs for diffusing light emitted by the LEDs;

a plurality of spacer sleeves each having a central hole therethrough and disposed between the diffuser and the central portion, the spacer sleeves being located between, and spaced from, the first and second strips and being spaced along the length of the central portion; and a plurality of threaded fasteners extending through the diffuser, through the spacer sleeve central holes, and through the central portion, wherein, the diffuser is in pressing contact with the spacer sleeves and secured to the channel by the threaded fasteners, the diffuser being secured to the channel solely by the threaded fasteners.

2. The surface mounted LED light structure of claim 1, further comprising:

the first base strip and respective LEDs being attached to the channel left leg outer surface; and the second base strip and respective LEDs being attached to the channel right leg outer surface.

3. The surface mounted LED light structure of claim 1, further comprising:

the first base strip and respective LEDs being attached to the channel left leg inner surface; and the second base strip and respective LEDs being attached to the channel right leg inner surface.

* * * * *